US007624667B2

(12) United States Patent
Kilkis

(10) Patent No.: US 7,624,667 B2
(45) Date of Patent: Dec. 1, 2009

(54) METHOD AND APPARATUS FOR REMOTELY PILOTED LANDMINE CLEARING PLATFORM WITH MULTIPLE SENSING MEANS

(76) Inventor: San Kilkis, 214 Locust St. SE, Apartment 120, Vienna, VA (US) 22180

( * ) Notice: Subject to any disclaimer, the term of this patent is extended or adjusted under 35 U.S.C. 154(b) by 222 days.

(21) Appl. No.: 11/130,100

(22) Filed: May 17, 2005

(65) Prior Publication Data

US 2005/0262995 A1 Dec. 1, 2005

Related U.S. Application Data

(60) Provisional application No. 60/571,912, filed on May 18, 2004.

(51) Int. Cl.
*B63G 7/08* (2006.01)
*B63G 7/06* (2006.01)

(52) U.S. Cl. ..... 89/1.13; 102/402

(58) Field of Classification Search ..... 89/1.13; 102/402, 403

See application file for complete search history.

(56) References Cited

U.S. PATENT DOCUMENTS 4,752,226 A * 6/1988 Akers et al. ..... 434/11
5,155,683 A * 10/1992 Rahim ..... 701/25
5,822,047 A * 10/1998 Contarino et al. ..... 356/5.01
6,055,214 A * 4/2000 Wilk ..... 367/99
6,341,551 B1 * 1/2002 Comeyne ..... 89/1.13
6,473,025 B2 * 10/2002 Stolarczyk et al. ..... 342/22

OTHER PUBLICATIONS

Merriam Webster Online definitions for the terms "miniature" and "land mine" conducted on May 19, 2008.*

* cited by examiner

*Primary Examiner*—Stephen M Johnson
(74) *Attorney, Agent, or Firm*—David R. Yohannan; Kelley Frye & Warren LLP

(57) ABSTRACT

A landmine detection and neutralization apparatus and method is disclosed. The apparatus to determine the location of landmines, comprises at least two detection modules utilizing different infrared, sound, and/or optical detection and a remotely operated miniature airborne vehicle, that may carry the detection modules at an optimum altitude over a surface that may contain landmines. The neutralization device may be a microwave and/or infrared wave generator. The method for determining the location of landmines comprises using at least two different landmine detection techniques where the techniques are infrared, sound, and optical detection, operating the detection techniques in a close proximity to a surface that may contain landmines and maintaining this close proximity by operating a remotely operated miniature airborne vehicle. Neutralization may be achieved by directing microwaves or infrared waves at detected landmines.

17 Claims, 5 Drawing Sheets

METHOD AND APPARATUS FOR REMOTELY PILOTED LANDMINE CLEARING PLATFORM WITH MULTIPLE SENSING MEANS

CROSS-REFERENCE TO RELATED APPLICATIONS

The present application relates to, and claims the priority of, U.S. Provisional Patent Application Ser. No. 60/571,912, filed May 18, 2004, which is entitled "Thermal and Infrared Camera Combination to Detect Landmines from a Remotely Piloted Mini Helicopter."

FIELD OF THE INVENTION

The present invention is generally directed to an apparatus and method for detecting and potentially neutralizing landmines. Specifically, the present invention is directed to an apparatus and method for detecting landmines which may use multiple sensors, thermal, acoustic, and/or electromagnetic sensors.

BACKGROUND OF THE INVENTION

Current statistics state that more than 26,000 people are killed or wounded by landmines every year. Approximately one death or injury occurs every twenty minutes. Presently, it is estimated that there are more than 100 million antipersonnel or antitank mines in more then seventy countries. Already, 11 million mines have been cleared from Egypt alone. However, over 308,800 square miles of mined land still exists in Sudan alone. The impact of this proliferation of mines is clear—in Afghanistan, three hundred to three hundred sixty people are killed by mines each month. In Cambodia, one out of every 236 people is a landmine amputee. With the current technology and efforts, all existing mines may not be cleared before the year of 2100.

Landmines are generally more prevalent in under-developed countries; countries which often do not possess the financial means to afford most landmine detection devices. Indeed, the cost to purchase and install a landmine is between $3 and $30 per device, while the cost to detect and remove a single landmine is between $300 and $1,000. More effective and less costly landmine detection and removal systems are needed now perhaps more than ever—in 1994, 200,000 landmines were removed, while 2 million new mines were planted.

The ease of detecting landmines is decreasing, due to two main factors. First, newer mines contain less metal and are often much smaller, thereby becoming more difficult to detect with existing and inexpensive technology. The size of newer antipersonnel mines range from 6 to 15 cm in diameter. Therefore, detection devices must be extremely accurate in locating the mines. The lack of metal in the landmine eliminates the efficacy of current, affordable detection devices, namely metal detectors. Second, older landmines have often been in place for extended periods-often so long that any visual indication of its planting has disappeared and vegetation has grown over its surface.

The existence of vegetation over older landmines presents additional problems, including the fact that such vegetation often causes distortion of present detection techniques, since such techniques cannot be practiced immediately above the soil surface.

Present methods of detecting landmines include using metal detectors, ground penetrating radar (GPR), infrared sensors (IR), dynamic thermography (DT), and ultra-sound (US). Each of these techniques has both benefits and drawbacks.

The drawbacks of metal detectors have been previously discussed. Essentially, more and more modern mines are being manufactured with little or no metal. For example, the PMN mine, previously manufactured by the Soviet Union, is enclosed in a thick rubber casing, thereby preventing most metal detecting devices from sensing its presence.

Ground penetrating radar (GPR) is a type of detection method that actively emits electromagnetic waves and collects reflected signals. The differences in the reflected signals may indicate where landmine may be buried. GPR may be limited by environmental conditions. For example, differences in humidity in soil may result in varying readings, often indicating a landmine when none actually exists. Further, ideal conditions for detecting landmines require not only dry, consistent soil, but also the use of a low frequency signal. Unfortunately, low frequency signals provide poor resolution images in determining where such landmines may be.

Standard Infrared (IR) detection devices, also referred to as thermal radiation detection devices, typically use electromagnetic, temporal waves to radiate the soil from a stationary platform. Things beneath the surface, such as landmines, are heated through the IR radiation and the temporal signature heated landmines produce. These signatures are generally not sufficient to detect single landmines. IR detection devices that move (i.e., are not stationary) generally need to use spatial electromagnetic waves. Spatial waves may provide better resolution than temporal waves. Infrared detection devices have been known to operate either passively or actively. Passive infrared sensors detect changes in temperature based upon the natural radiation of an object, often because of changing environmental (i.e., weather) conditions. Drawbacks of known passive infrared detection techniques include the slight disparity in temperature that generally occurs through the day between a landmine and the ambient soil it is buried in. Further, results may be greatly skewed by environmental conditions (i.e., a cool wind blowing over warm soil may disrupt readings). Active infrared detection devices utilize infrared radiation to heat bodies in a wall or another medium in order to artificially stimulate their thermal signature to be detected by IR cameras. Active infrared detectors also have drawbacks, including cost, size, and weight.

Ultrasound (US) detection devices generally emit a high frequency sound (above the audible range) and collect reflections of this sound. A difference between US and GPR methods is that GPR does not cause any physical effects, while US does. As the US sound wave propagates through a medium, the sound wave causes molecules of the medium to oscillate around their equilibrium position. If the medium is entirely homogenous, i.e., no landmines, the US wave will continue propagating. If a different medium is encountered, the US wave is generally reflected and refracted. Thus, when US waves are reflected and refracted back to sensors, it is an indication of a possible landmine location. The main drawback of US detection devices is that US waves tend to greatly attenuate when the medium is air. US detection devices work best when there is little to no air gap between the emitter and the desired medium, i.e., the soil. As it is often difficult and unsafe to have a US detection device in direct contact with the soil, the results of such devices may be somewhat unreliable, due to this distance.

It has also been found that ultrasound and audible sound waves may be used to determine where landmines may be located. These waves may be transmitted toward the surface to be tested, and the reflected waves collected and analyzed.

Studies have shown that when the sound waves encounter a landmine or similar foreign body, they are reflected back at a different rate than waves reflected due to normal soil conditions. By analyzing this data and comparing the differential in reflection rates, possible landmine locations may be ascertained. The device for digitally recording the reflected sound waves from a directional high sensitivity microphone is referred to herein as an "acoustic camera" for simplicity.

There are further drawbacks associated with each of the discussed detection devices. Generally, their costs are prohibitive, especially to the under-developed countries that most have the need for them. Further, the majority of devices require direct human operation, thereby placing lives in jeopardy.

Thus, there is a need for a more reliable, effective, inexpensive, and/or remotely operated landmine detection device. There is further a need for landmine detection device that may operate near enough to the surface to be tested to provide accurate readings, but for safety reasons avoids contacting the surface to be tested.

Additional advantages of embodiments of the invention are set forth, in part, in the description that follows and, in part, will be apparent to one of ordinary skill in the art from the description and/or from the practice of the invention.

SUMMARY OF THE INVENTION

Responsive to the foregoing challenges, the Applicant has developed an innovative method and apparatus a landmine detection apparatus for determining the location of landmines, comprising at least two detection modules utilizing different detection techniques and a remotely operated miniature airborne vehicle, said remotely operated miniature airborne vehicle carrying said at least two detection modules at an optimum altitude over a surface that may contain landmines.

Applicant has further developed a method for detecting the location of landmines, the method comprising the steps of using at least two different landmine detection techniques, operating said landmine detection techniques in a close proximity to a surface that may contain landmines, and maintaining said close proximity by operating a remotely operated miniature airborne vehicle.

Applicant has further developed an detection apparatus for determining the location of underground utilities, comprising at least two detection modules utilizing different detection techniques, wherein each of the at least two detection modules is selected from a list consisting of: an infrared detection module, an acoustic and ultrasonic sound detection module, and an optical detection module; and a remotely operated miniature airborne vehicle, said remotely operated miniature airborne vehicle carrying said at least two detection modules at an optimum altitude over the underground utilities.

Applicant has further developed a detection apparatus for determining the location of possible explosive devices located in railways, comprising: at least two detection modules utilizing different detection techniques, wherein each of the at least two detection modules is selected from a list consisting of: an infrared detection module, an acoustic and ultrasonic sound detection module, and an optical detection module; and a remotely operated robot, said remotely operated robot carrying said at least two detection modules and traveling over the railway to be tested.

Applicant has further still developed a method for detecting underground abnormalities, the method comprising the steps of: using at least two different underground abnormalities detection techniques, selected from the list consisting of: infrared detection, acoustic and ultrasonic sound detection, and optical detection; operating said underground abnormalities detection techniques in a close proximity to the ground surface; and maintaining said close proximity by operating a remotely operated miniature airborne vehicle.

A method for detecting household abnormalities, the method comprising the steps of: using at least two different household abnormalities detection techniques, selected from the list consisting of: infrared detection, acoustic and ultrasonic sound detection, and optical detection; and operating said household abnormalities detection techniques from a stationary location positioned above the household.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

In order to assist the understanding of this invention, reference will now be made to the appended drawings, in which like reference numerals refer to like elements. The drawings are exemplary only, and should not be construed as limiting the invention.

DETAILED DESCRIPTION OF PREFERRED EMBODIMENTS OF THE INVENTION

Reference will now be made in detail to embodiments of the system and method of the present invention, examples of which are illustrated in the accompanying drawings. As embodied herein, the present invention includes systems and methods of detecting landmines.

Figure 1:
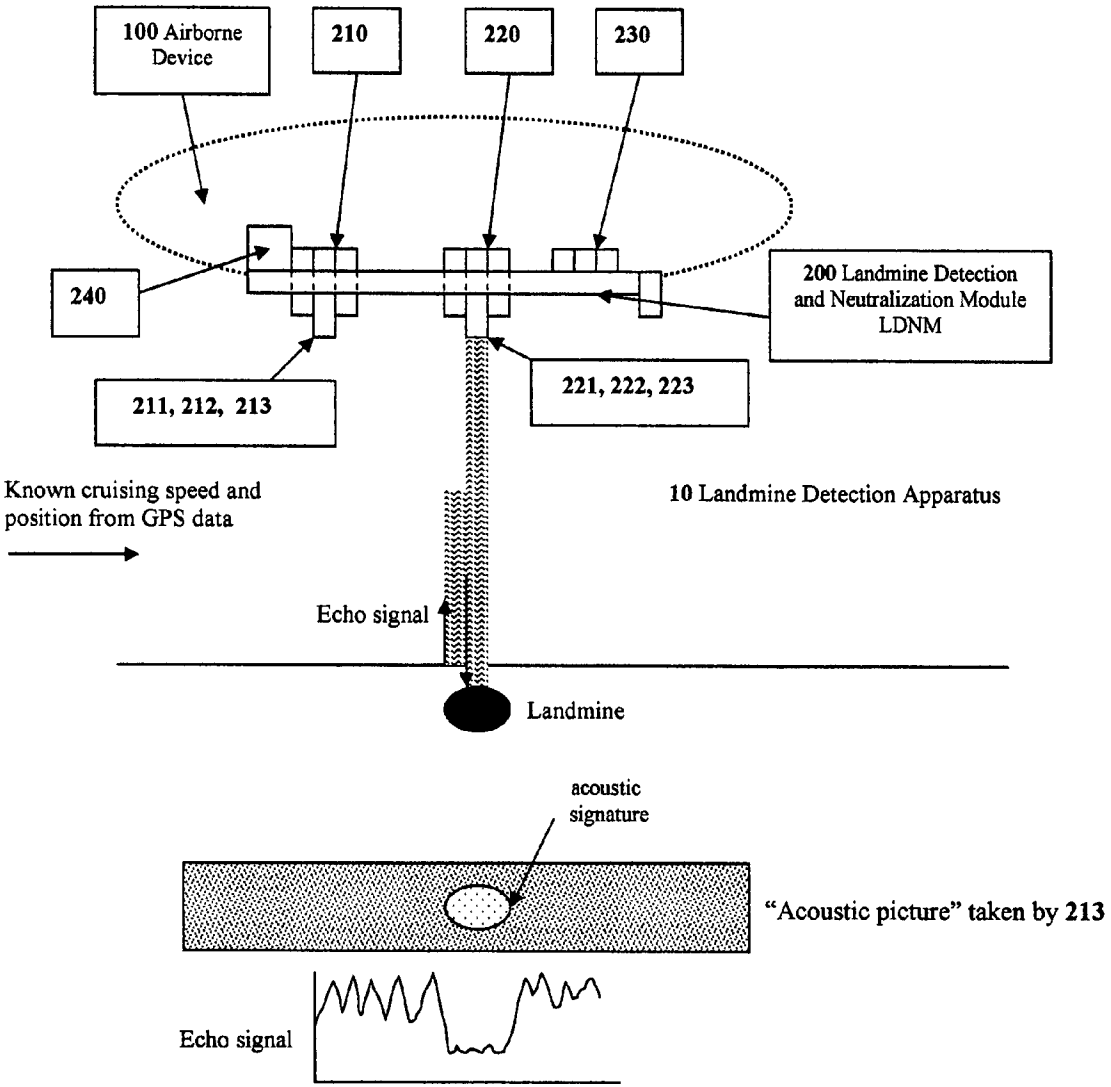
FIG. 1 is a schematic diagram of a landmine detection system operated in accordance with a first embodiment of the present invention.

With reference to FIG. 1, a first embodiment of the present invention will be described. In the first embodiment of the present invention a landmine detection apparatus 10, which may be comprised of a Landmine Detection and Neutralization Module (LDNM) 200, may be suspended or an integral part of airborne device 100. The airborne device 100 may be, but is not limited to, a miniature remote control helicopter, airplane, blimp, balloon, and/or any other suitable device for remotely maintaining a low flying or hovering altitude above the surface to be tested. It is contemplated that the airborne device 100 may be replaced with any other remotely operated vehicle, such as but not limited to a remote control car. The LDNM 200 may be attached to the airborne device 100 by any suitable means, that will provide the LDNM with a direct line of sight to the surface to be tested.

Figure 2:
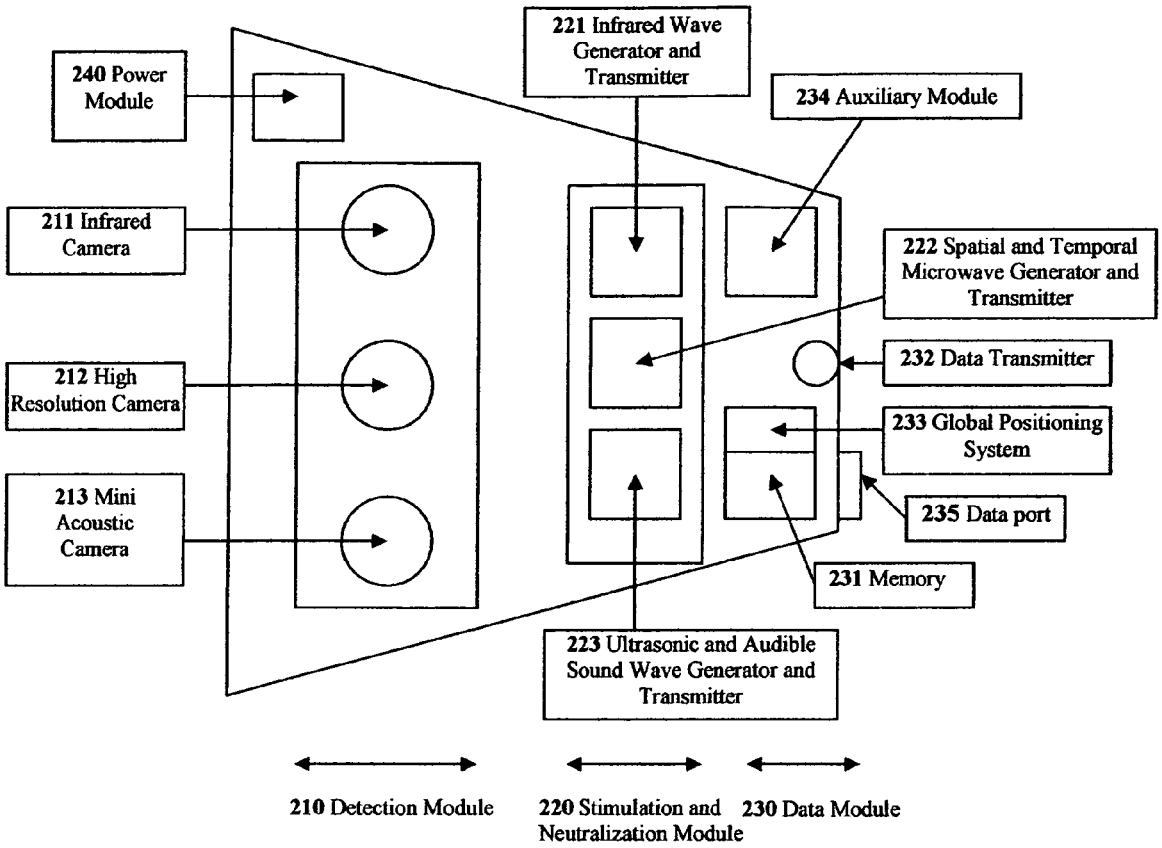
FIG. 2 is a schematic diagram of an integrated, hybrid landmine neutralization and detection module, construed in accordance with an embodiment of the present invention.

With reference to FIGS. 1 and 2, the LDNM 200 may be comprised of modules, namely a detection module 210, a stimulation and neutralization module 220, a data module 230, and a power module 240. The detection module 210 may be comprised of three components, an infrared camera 211, a high-resolution optical camera 212, and an acoustic camera 213. Each of these components may be arranged in the detection module 210 in any manner in which each component is able to view and/or receive reflected waves from the surface to be tested. Each component, the infrared camera 211, the high-resolution camera 212, and the acoustic camera 213, may be miniature and lightweight, in order to be more easily carried by the airborne device 100. The high-resolution camera 212 may be equipped with night-vision capabilities.

With continued reference to FIGS. 1 and 2, the stimulation and neutralization module 220 may be comprised of three main sub-modules, namely an infrared wave generator and transmitter 221, a spatial and temporal microwave generator and transmitter 222, and an ultrasonic and audible sound wave generator and transmitter 223. Each of these components may be disposed on the LDNM 200 in any such manner that the waves produced may be directed at the surface to be tested for landmines. As with the detection module 210, each component in the stimulation and neutralization module 220 may be miniature and lightweight in order to be more easily carried by the airborne device 100.

The infrared wave generator and transmitter 221 and the infrared camera 211 may be situated such that the electromagnetic waves generated and transmitted by the infrared wave generator and transmitter 221 may be reflected from the surface to be tested back to the infrared camera 211. Similarly, the spatial and temporal microwave generator and transmitter 222 and the infrared camera 211 may be positioned such that the electromagnetic waves generated and transmitted may be reflected from the surface to be tested back to the infrared camera 213. Similarly, the ultrasound and audible sound wave generator and transmitter 223 and the acoustic camera 213 may be positioned such that sound waves generated and transmitted by the ultrasound and audible sound wave generator and transmitter 223 may be reflected from the surface to be tested back to the acoustic camera 213. The acoustic camera 213 may recognize the acoustic signature of a potential landmine.

The data module 230 may contain various sub-modules directed at storing and transmitting the data received by the detection module 210, as well as sub-modules containing the positioning data of the landmine detection apparatus 10. The data module 230 may contain a memory 231 for storing data, a data transmitter 232 for transmitting data back to a home location during operation of the landmine detection apparatus 10, a global positioning system 233 for determining where the landmine detection apparatus 10 is precisely located for flagging and removal of detected landmines, and an auxiliary module 234. The auxiliary module 234 may be used to mount a fourth sensing device, and/or any other system that would be beneficial (e.g. backup power, etc.) to the function and/or operation of the landmine detection apparatus 10.

The power module 240 provides the necessary power in the necessary form for each of the systems onboard the LDNM 200.

Figure 3:
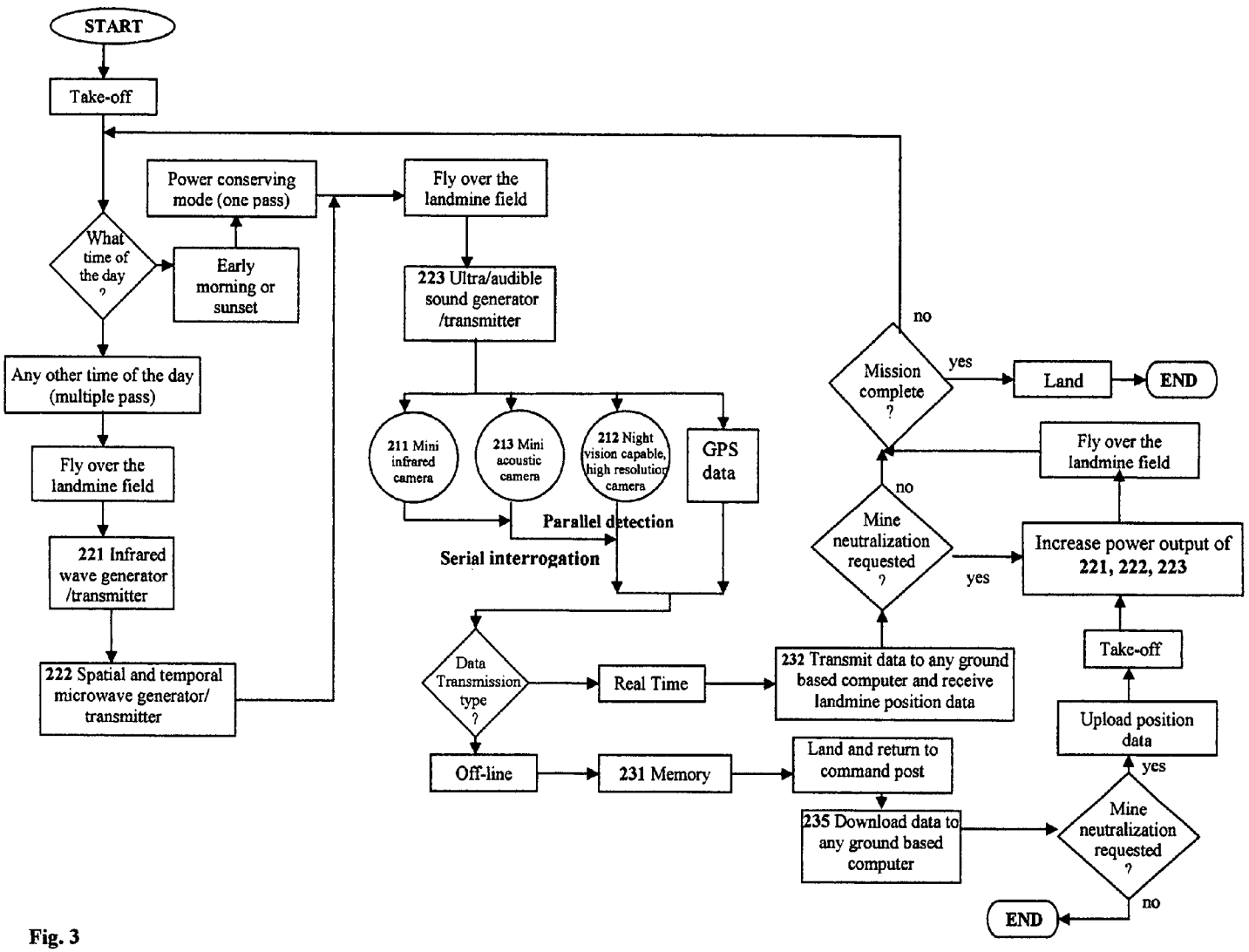
FIG. 3 is a flow-chart illustrating a method of detecting and/or neutralizing landmines in accordance with an embodiment of the present invention.

With reference to FIGS. 1-3, the function of the mine detection system 10 will now be discussed. The following description of use will explain the system when all detection techniques are used simultaneously, although the present invention fully contemplates the use of any method alone or in conjunction with one or more other methods.

The airborne device 100 may be remotely controlled by an operator located at a base location. The location from which the operator may control the landmine detection apparatus 10 may be different from the base to which the landmine detection apparatus 10 may take off from and return to. Further, the operator may be located in a full sized airborne vehicle, or in another place of safety. The operator may control the airborne device 100 to take off at a desired time. The airborne device 100 may take off from a safe location or it may be released from a mother airborne vessel. The airborne device 100 may carry the LDNM 200 at an optimum altitude above the surface to be tested. A preferred altitude generally may be between 1 and 5 meters, however, the invention should not be limited in this respect. The time of during which the LDNM 200 is used may determine which systems of the LDNM 200 are utilized. For example, in early morning or sundown, it may be possible to use natural geothermal deviations caused by the presence of a mine or similar foreign body to determine its location through its thermal signature on the surface to be tested. This is due to the inconsistent rates at which the ambient soil and the mine warm up or cool down.

The mine detection apparatus 10 may determine thermal differences between the ambient soil and the mine based upon natural geothermal events (i.e. sunrise or sunset). If the operation is not during this time period, then the landmine detection apparatus 10 may perform an initial "fly over" of the area to be tested, with the infrared wave generator and transmitter 221 and the spatial and temporal microwave generator and transmitter 222 activated, so as to stimulate (i.e., not the result of natural geothermal events) thermal signatures of the landmine.

Figure 4:
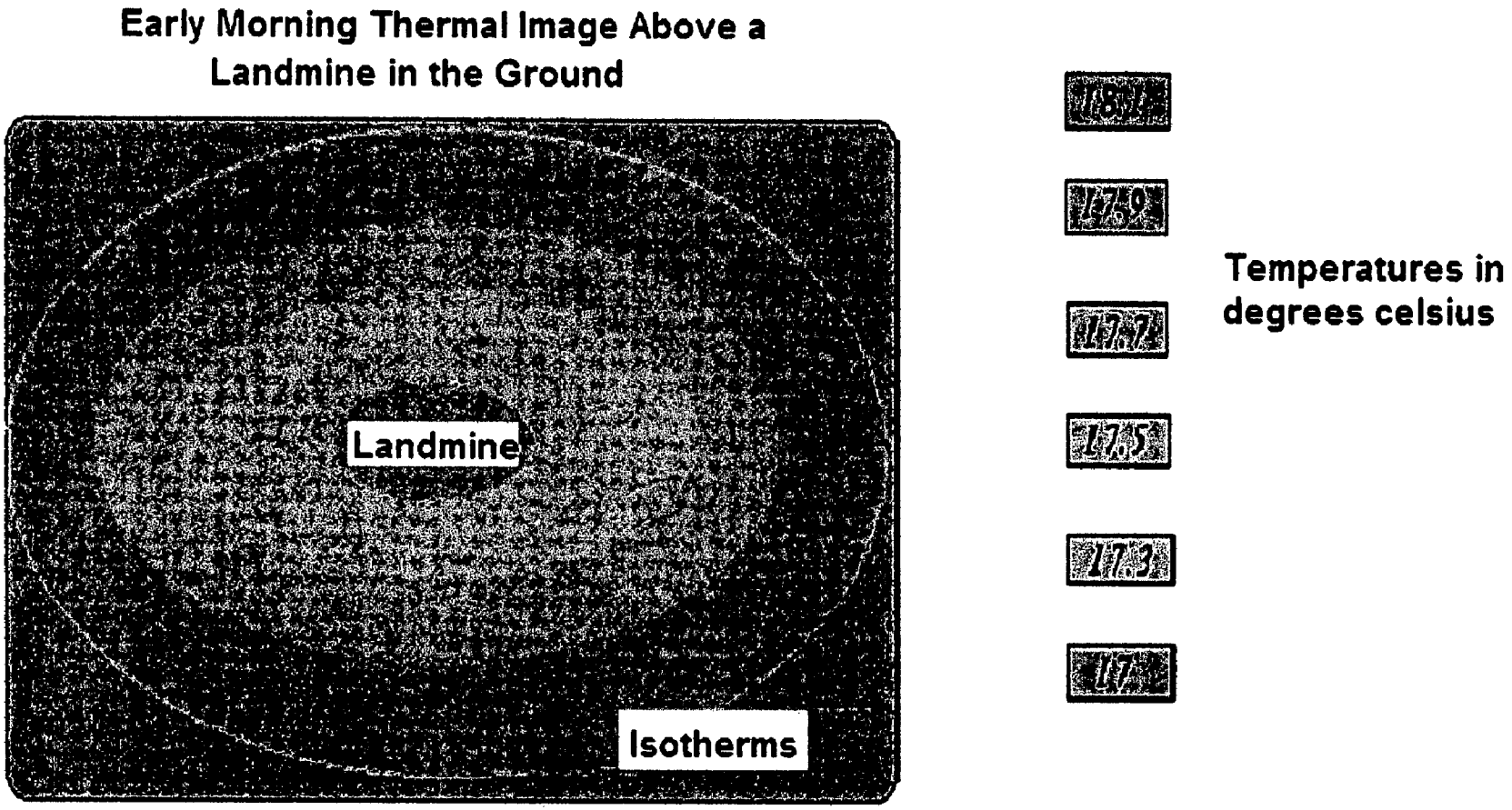
FIG. 4 is an illustration of the thermal signature produced by a potential landmine due to natural geothermal events when utilizing a landmine detection system construed in accordance with an embodiment of the present invention.
Figure 5:
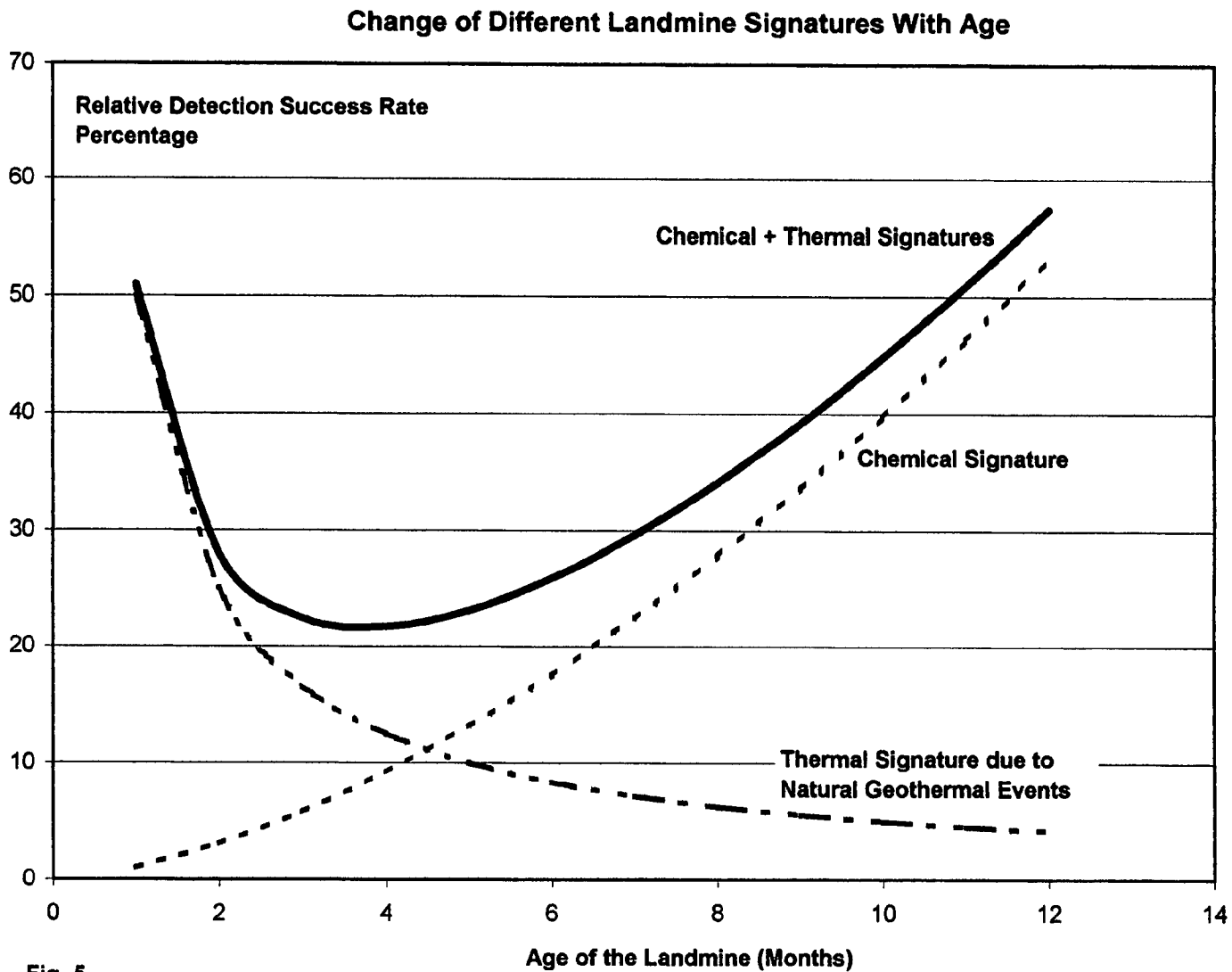
FIG. 5 is a graph illustrating the variation of thermal and chemical signature detection success rates relative to landmine age.

The airborne device 100 may be remotely controlled by an operator who is at a safe distance from the area to be tested, or the airborne device 100 may fly in a predetermined and preprogrammed path over the area to be tested. As the landmine detection apparatus 10 flies over the area to be tested, the infrared wave generator and transmitter 221, the spatial and temporal microwave generator and transmitter 222 and the ultrasound and audible sound wave generator and transmitter 223 may be active, directing infrared waves, spatial and temporal microwaves, and ultrasound and audible sound waves, respectively, at the surface to be tested. As the landmine detection apparatus 10 continues on its course, the infrared camera 211 may take pictures of thermal deviations on the surface to be tested, caused by both natural geothermal events and the impingement of infrared waves on the surface to be tested by the infrared wave and microwave generators and transmitters 221 and 222. A exemplary thermal image that may be generated by the infrared camera is illustrated in FIG. 4. With continued reference to FIGS. 1 and 2, the acoustic camera 213 may receive acoustic waves created by the ultrasonic and audible sound wave generator and transmitter 223 that have been reflected off the surface to be tested. The high resolution camera 212 may take multiple pictures of the area to be tested, in order to determine if there are any differences in the vegetation growth, coloring, and/or color reflectance that may be due to explosive leaks, thereby indicating the presence of a possible mine.

The present invention uses multiple, parallel sensors simultaneously on an integrated platform. An advantage of this apparatus may be that it increases the total reliability and accuracy of detection and neutralization by offsetting the disadvantages of individual sensors with the advantages of other sensors. The present invention may therefore reduce the need for high accuracy levels for each individual sensor, yet increase the total reliability and accuracy of the detection device. The parallel plurality of sensors and series interrogation protocol reduce the false alarm rates.

The landmine detection apparatus 10 may be operated on at least two data transfer modes: an online mode that streams data back to a base location in real time, or an offline mode that stores the data onboard the landmine detection apparatus 10 to be downloaded once the landmine detection apparatus 10 returns to the base location.

If the landmine detection apparatus 10 is in an online mode, then as the infrared camera 211, high-resolution camera 212, and/or acoustic camera 213 capture data, it may be relayed back to the base location in real time. Additionally, the exact location of the landmine detection apparatus 10 may be determined by a global positioning system 233 and relayed back to the base location concurrently, so that the data obtained from the various sensors and cameras may be associated with a specific location. The data may be transmitted back to the base location by the data transmitter 232, which may be any capable of transferring data from one location to another, preferable via a wireless connection.

If the landmine detection apparatus 10 is in an offline mode, then the data captured by the infrared camera 211, high-resolution camera 212, and/or the acoustic camera 213 and the global positioning system 233 may be stored in an onboard memory 231. Once the landmine detection apparatus 10 returns to the base location, this information and data may be downloaded from the apparatus by connecting a device suitable of reading and saving the data to a data port 235 located on the LDNM 200. By operating the landmine detection apparatus 10 in an offline mode, extraneous hardware may not be needed on board of the LDNM 200, and instead may be located at the base location. The location of the hardware and accompanying devices to manipulate and analyze the collected data on a computer system separate from the LDNM 200 may allow the LDNM 200 to be more lightweight. This separate computer system may be land or sea based and may also be onboard a different aircraft.

If during operation of the landmine detection apparatus 10 in an online mode it is determined that neutralization of specific mines is required, then the landmine detection apparatus may return to a position over the specific mine to be neutralized. If the landmine detection apparatus 10 is operating in an offline mode and it is determined that neutralization of a specific mine is required, then the landmine detection apparatus may take off again and be controlled to a position over the specific mine to be neutralized.

Once the landmine detection apparatus 10 is in a position to neutralize a specific mine, the power output of the infrared wave generator and transmitter 221, the microwave generator and transmitter 222, and the ultrasound and audible sound wave generator and transmitter 223 are increased. These generator and transmitters, 221, 222, 223 may cause damage to the triggering mechanism of the landmine, thereby disabling it from detonating and making it safe for removal. Detection signals from all sensors and stimulating devices that may be on board the landmine detection apparatus 10 may be passed through an interrogation module (not shown) in a series protocol in order to minimize false alarms.

In a second embodiment of the present invention, the landmine detection techniques may be utilized to determine the location of underground utilities, possible explosive devices located in railways, leaks in pipes embedded within a household, and/or electrical shorts in wiring embedded within a household.

In a third embodiment of the present invention, the landmine detection and neutralization techniques may be utilized over water or ice like a sea, pond, river or marshland.

It will be apparent to those skilled in the art that variations and modifications of the present invention can be made without departing from the scope or spirit of the invention. Thus, it is intended that the present invention cover all such modifications and variations of the invention, provided they come within the scope of the appended claims and their equivalents.

What is claimed is:

1. A method for detecting the location of landmines, comprising:

using acoustic and ultrasonic sound landmine detection technique, in addition to at least two other landmine detection techniques;

operating said landmine detection techniques in a close proximity to a land surface that may contain mines; and maintaining said close proximity by operating a remotely operated miniature airborne vehicle.

2. The landmine detection method of claim 1, wherein each of the at least two detection techniques is selected from: infrared detection, detecting geothermal differences, and optical detection.

3. The landmine detection method from claim 1, wherein using two other landmine detection techniques further comprises using at least three detection techniques.

4. The landmine detection method of claim 3, wherein the three detection techniques are selected from the group consisting of:

an infrared detection technique;

geothermal differences detection technique; and an optical detection technique.

5. The landmine detection method of claim 1, further comprising:

neutralizing located landmines.

6. The landmine detection method of claim 5, wherein neutralizing located landmines comprises directing generated microwaves at the landmine.

7. The landmine detection method of claim 5, wherein neutralizing located landmines comprises directing generated infrared waves at the landmine.

8. The landmine detection method of claim 5, wherein neutralizing located landmines comprises directing generated microwaves and infrared waves at the landmine.

9. The landmine detection method of claim 8, wherein the generated microwaves are selected from: spatial waves, temporal waves, and spatial and temporal waves.

10. The landmine detection method of claim 1, wherein using two other detection techniques is further characterized by using naturally existing geothermal differences in order to determine the location of the landmines.

11. The landmine detection method of claim 1, wherein using two other detection techniques is further characterized by using geothermal differences created both naturally and through the use of artificially supplied infrared waves and microwaves in order to determine the location of the landmines.

12. The landmine detection method of claim 1, wherein the step of using two other detection techniques is further characterized by using differences in vegetation coloring and vegetation color reflectance in order to determine the location of the landmines.

13. The landmine detection method of claim 1, further comprising determining the location of the landmine detection apparatus and the location of determined landmines through the use of a global positioning system.

14. The landmine detection method of claim 1, further comprising relaying the location of the landmine detection apparatus and detected landmines to a home base location through the use of a communication system.

15. The landmine detection method of claim 1, wherein maintaining said close proximity by operating a remotely operated miniature airborne vehicle is further characterized by remotely operating a miniature vehicle that may travel in contact with the surface to be tested.

16. The landmine detection method of claim 1, further comprising detecting mines in water and ice.

17. A method for detecting underground abnormalities:

using acoustic and ultrasonic sound landmine detection technique, in addition to at least two other underground abnormalities detection techniques, selected from the list consisting of:

an infrared detection technique, geothermal differences detection technique, and an optical detection technique;

operating said underground abnormalities detection techniques in a close proximity to the ground surface; and maintaining said close proximity by operating a remotely operated miniature airborne vehicle.

* * * * *